US007784981B2

(12) United States Patent
Xiao et al.

(10) Patent No.: US 7,784,981 B2
(45) Date of Patent: Aug. 31, 2010

(54) SOLAR LED LAMP ASSEMBLY

(75) Inventors: Xin-Jian Xiao, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 127 days.

(21) Appl. No.: 12/235,610

(22) Filed: Sep. 23, 2008

(65) Prior Publication Data

US 2010/0073920 A1 Mar. 25, 2010

(51) Int. Cl.
*F21S 13/10* (2006.01)

(52) U.S. Cl. ..... 362/431; 362/192; 362/294

(58) Field of Classification Search ..... 362/431, 362/191, 183, 192, 294, 373
See application file for complete search history.

(56) References Cited

U.S. PATENT DOCUMENTS 7,018,063 B2 * 3/2006 Michael et al. ..... 362/183
7,090,370 B2 * 8/2006 Clark et al. ..... 362/183
2006/0250803 A1 * 11/2006 Chen ..... 362/373

* cited by examiner

*Primary Examiner*—Ali Alavi
(74) *Attorney, Agent, or Firm*—Frank R. Niranjan

(57) ABSTRACT

A solar LED lamp assembly includes a bracket, an LED lamp mounted on a bottom end of the bracket, a solar panel assembly slantwise mounted on a top end of the bracket and electronically connecting the LED lamp, and a reflector sandwiched between the solar panel assembly and the top end of the bracket and oriented towards the LED lamp. The LED lamp includes a heat sink and a printed circuit board mounted with a plurality of LED modules thereon and received in the heat sink.

9 Claims, 4 Drawing Sheets

SOLAR LED LAMP ASSEMBLY

BACKGROUND OF THE INVENTION

1. Field of the Invention

The present invention relates to a solar LED lamp assembly, and more particularly to a solar LED lamp assembly which utilizes a solar energy to drive an LED lamp.

2. Description of Related Art

LED lamp assemblies are highly energy efficient electrical light sources, and are increasingly being considered for indoor or outdoor lighting purposes. An LED lamp assembly comprises an LED lamp and an electric source for driving the LED lamp. When the LED lamp assembly works, an electrical energy is consumed. However, such LED lamp assembly cannot be used in some districts such as a district deep in the mountains where it is difficult to supply any electric power.

What is needed, therefore, is a solar LED lamp assembly which can overcome the above-mentioned disadvantages.

SUMMARY OF THE INVENTION

A solar LED lamp assembly includes a bracket, an LED lamp mounted on a bottom end of the bracket, a solar panel assembly slantwise mounted on a top end of the bracket and electronically connecting with the LED lamp, and a reflector sandwiched between the solar panel assembly and the top end of the bracket and oriented towards the LED lamp. The LED lamp includes a heat sink and a printed circuit board mounted with a plurality of LED modules thereon and received in the heat sink.

Other advantages and novel features of the present invention will become more apparent from the following detailed description when taken in conjunction with the accompanying drawings.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
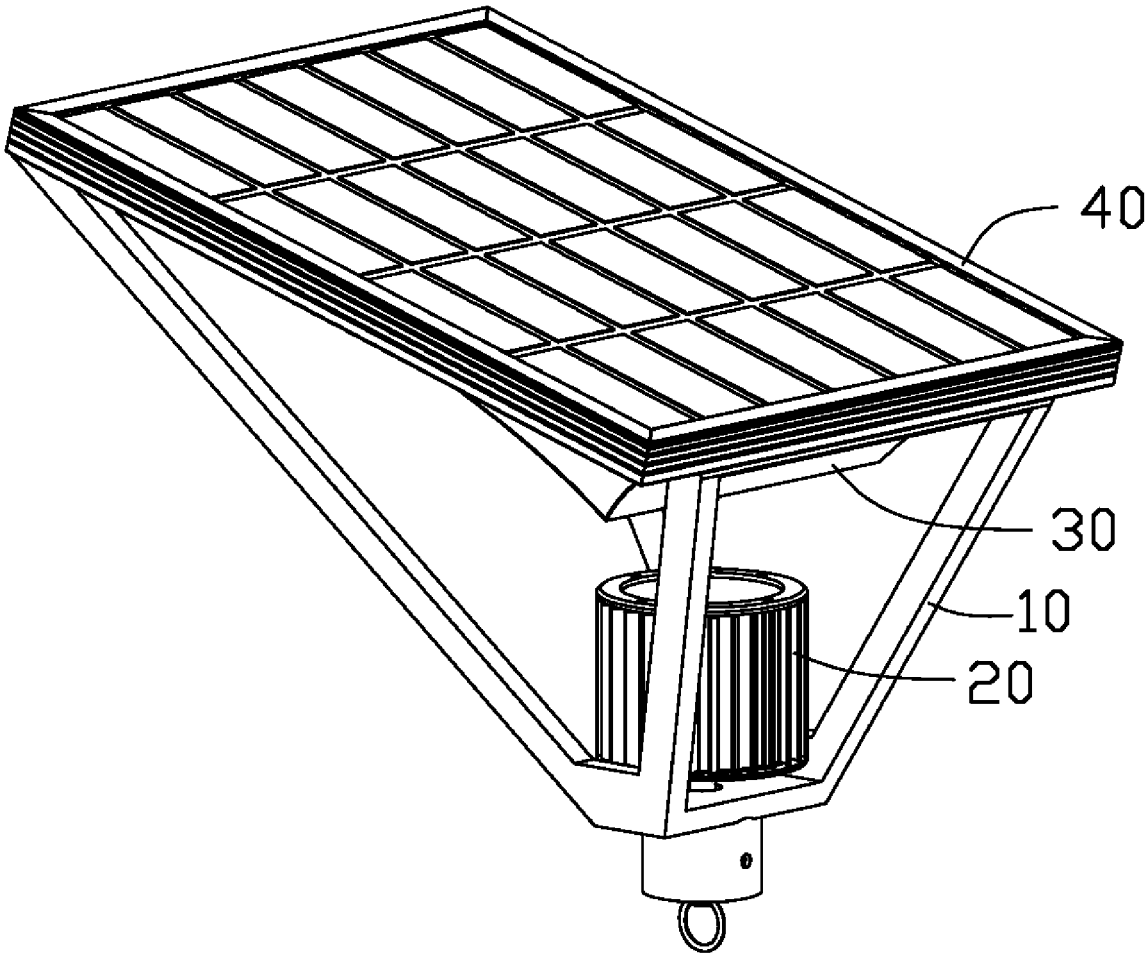
FIG. 1 is an assembled, isometric view of a solar LED lamp assembly in accordance with a preferred embodiment of the present invention.
Figure 2:
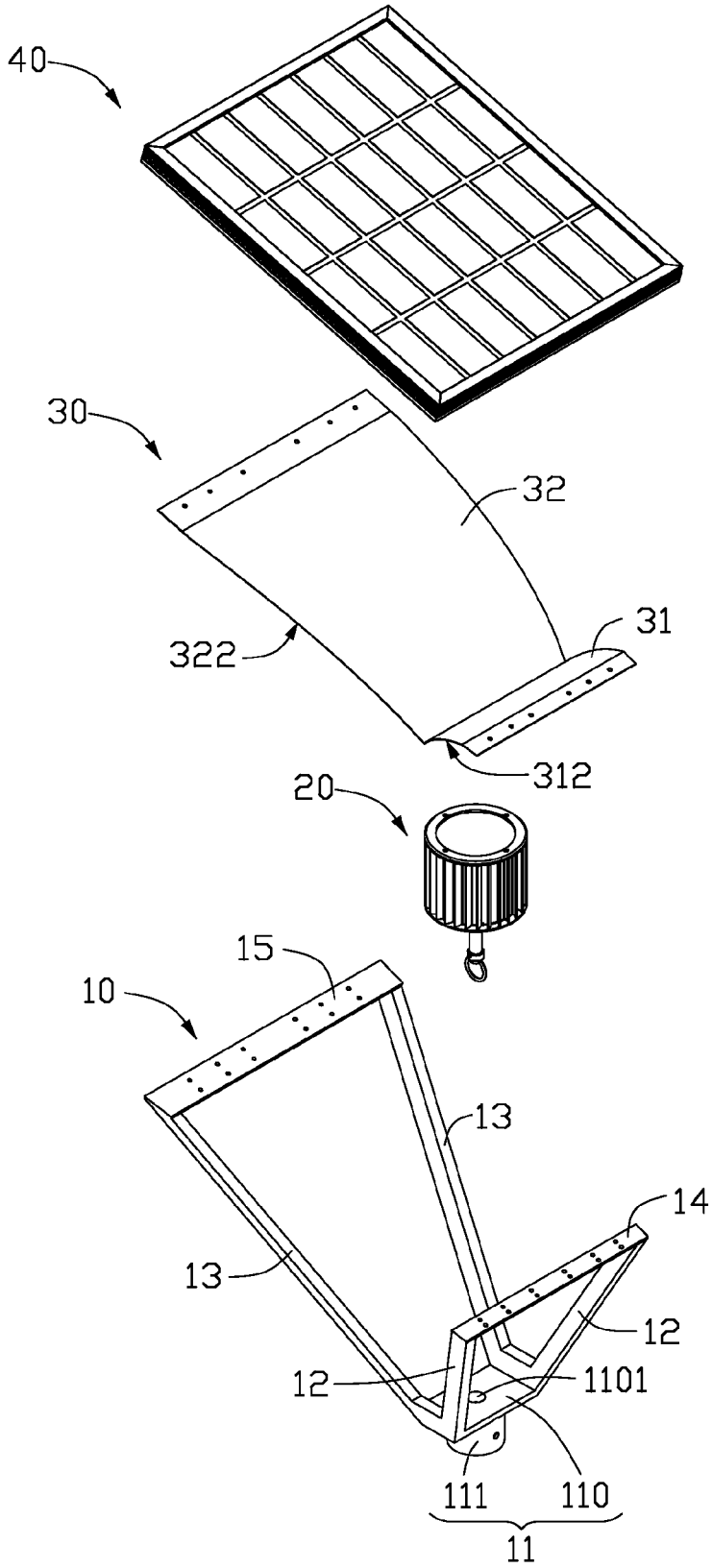
FIG. 2 is an exploded view of FIG. 1.

Referring to FIGS. 1-2, a solar LED lamp assembly for a lighting purpose comprises a bracket 10, an LED lamp 20 mounted on a bottom portion of the bracket 10, a solar panel assembly 40 mounted on a top end of the bracket 10, and a reflector 30 sandwiched between the solar panel assembly 40 and the top end of the bracket 10 to reflect light emitted from the LED lamp 20 downwardly.

The bracket 10 has a V-shaped configuration. The bracket 10 comprises a mounting portion 11, a pair of first supporting arms 12 and a pair of second supporting arms 13 extending slantwise and upwardly from opposite ends of the mounting portion 11. The mounting portion 11 comprises an elongated mounting plate 110 and a cylindrical fixture 111 extending downwardly from a central portion of the mounting plate 110. A through hole 1101 is defined in a center of the mounting portion 11. The first and second supporting arms 12, 13 extend from opposite edges of the mounting plate 110 of the mounting portion 11. A length of the second supporting arm 13 is longer than that of the first supporting arm 12, and a height of the second supporting arm 13 in a vertical direction is larger than that of the first supporting arm 12. The first supporting arms 12 are elongated poles and spaced from each other. An elongated first connecting portion 14 is mounted on and connects top ends of the first supporting arms 12 together and is parallel to a top surface of the mounting plate 110 of the mounting portion 11. The second supporting arms 13 are elongated poles and spaced from each other. An elongated second connecting portion 15 is mounted on and connects top ends of the second supporting arms 13 together and extends slantwise and downwardly from the top ends of the second supporting arms 13 toward the top ends of the first supporting arms 12. The solar plane assembly 40 is mounted on the first and second connecting portions 14, 15 and angles with mounting plate 110 of the mounting portion 11.

Figure 3:
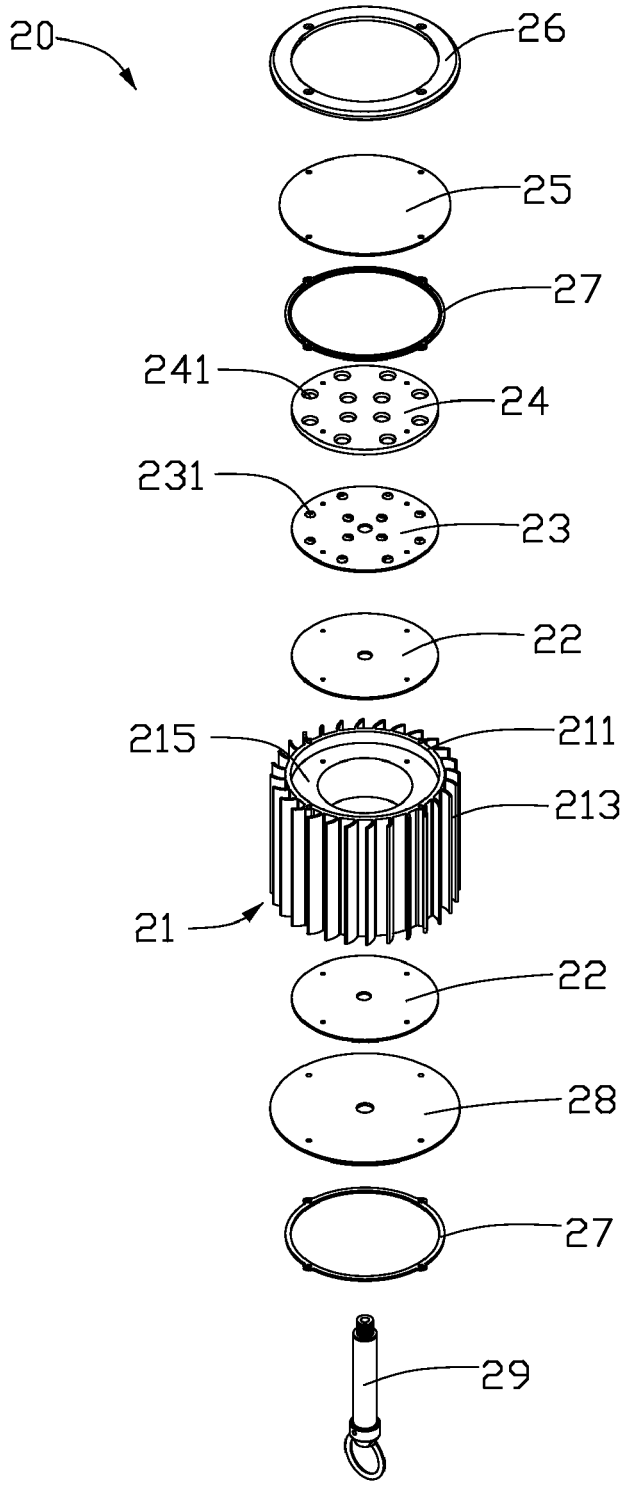
FIG. 3 is an exploded view of an LED lamp of the solar LED lamp assembly of FIG. 1.
Figure 4:
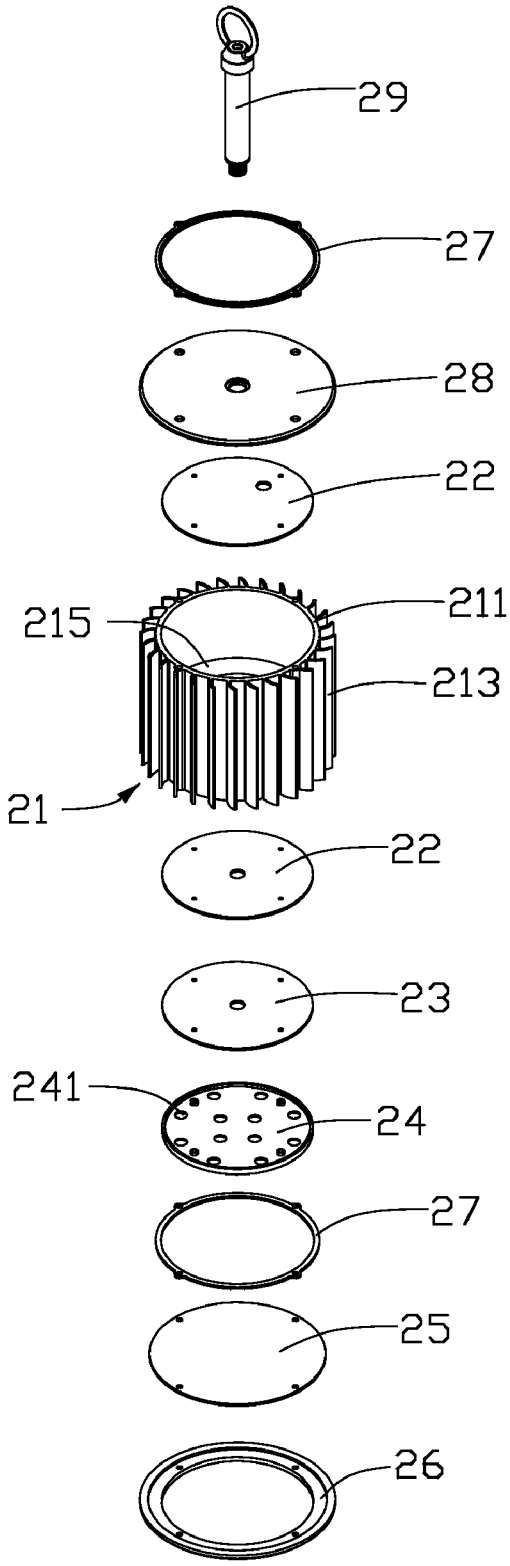
FIG. 4 is an inverted view of FIG. 3.

Referring to FIGS. 3-4 also, the LED lamp 20 comprises a heat sink 21. The heat sink 21 comprises an annular receiving portion 211, a plurality of fins 213 extending outwardly from an outer wall of the receiving portion 211, and a supporting portion 215 extending inwardly from an inner wall of the receiving portion 211. The supporting portion 215 is a cylinder with a through hole in a center thereof. The supporting portion 215 is surrounded by the receiving portion 211. The receiving portion 211 has top and bottom ends thereof extending upwardly and downwardly beyond top and bottom ends of the supporting portion 215. A pair of thermally conductive plates 22 are received in the heat sink 21 and abut against the top and bottom ends of the supporting portion 215 of the heat sink 21, respectively. A printed circuit board 23 with a plurality of LED modules 231 is mounted on the thermally conductive plate 22 located at the top end of the supporting portion 215. A reflecting member 24 with a plurality of receiving holes 241 for the LED modules 231 covers the printed circuit board 23 and receives the LED modules 231 in the receiving holes 241 thereof. A transparent top cover 25 abuts against a top end of the heat sink 21. A securing portion 26 presses the top cover 25 and engages with the top end of the heat sink 21 to secure the top cover 25 on the heat sink 21. A bottom cover 28 is mounted on a bottom end of the heat sink 21 to hermetically seal the bottom end of the heat sink 21. A pair of gaskets 27 are sandwiched between the heat sink 21 and the top and bottom covers 25, 28 respectively to provide a waterproof sealing at each of joints between the heat sink 21 and the top and bottom covers 25, 28. A linking member 29 is mounted on the bottom end of the LED lamp 20 and extends through the through hole 1101 of the mounting portion 11 of the bracket 10.

The reflector 30 has a generally V-shaped configuration. The reflector 30 comprises an arc-shaped first reflecting portion 31 and an arc-shaped second reflecting portion 32 extending upwardly and slantwise from an edge of the first reflecting portion 31. An area of the first reflecting portion 31 is smaller than that of the second reflecting portion 32. The first and second reflecting portions 31, 32 each have a concave surface 312, 322 facing downwardly and outwardly toward opposite directions. The first and second reflecting portions 31, 32 are mounted to the first and second connecting portions 14, 15 to mount the reflector 30 on the bracket 10. Outer edges of the first and second reflecting portions 31, 32 connect top surfaces of the first and second connecting portions 14, 15, respectively. The reflector 30 is spaced from the LED lamp 20. When the LED lamp 20 works, light emitted from the LED lamp 20 is reflected to orient towards different directions via the reflector 30, whereby the solar LED lamp assembly can have a large illumination angle.

The solar panel assembly 40 is mounted on the top end of the bracket 10. The solar panel assembly 40 is rectangular. The solar panel assembly 40 is used to convert the solar energy into electrical energy. The electrical energy is stored in the solar panel assembly 40, which connects with the LED lamp 20 via a switch (not shown). The solar LED lamp assembly is equipped with a light sensor (not shown) which can detect a brightness of an environment of the solar LED lamp assembly. When the environment is dark enough, the sensor sends a signal to the switch (not shown) to turn on the switch. The switch then electrically connects the solar panel assembly 40 and the LED lamp 20, thereby enabling the electric power stored in the solar panel assembly 40 to be provided to the LED lamp 20.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A solar LED lamp assembly for lighting purpose comprising:

a bracket;

an LED lamp mounted on a bottom end of the bracket, the LED lamp comprising a heat sink and a printed circuit board mounted with a plurality of LED modules thereon and received in the heat sink;

a solar panel assembly slantwise mounted on a top end of the bracket and electronically connecting the LED lamp; and a reflector sandwiched between the solar panel assembly and the top end of the bracket and oriented towards the LED lamp;

wherein the bracket comprises a mounting portion, a pair of first supporting arms and a pair of second supporting arms extending slantwise and upwardly from opposite ends of the mounting portion, the LED lamp being mounted on a top of the mounting portion, the reflector and the solar panel assembly mounted on tops of the first and second supporting arms.

2. The solar LED lamp assembly of claim 1, wherein the reflector comprises an arc-shaped first reflecting portion and an arc-shaped second reflecting portion extending upwardly and slantwise from an edge of the first reflecting portion, the first and second reflecting portions facing downwardly toward the LED lamp and outwardly towards opposite directions.

3. The solar LED lamp assembly of claim 2, wherein an area of the first reflecting portion is smaller than that of the second reflecting portion.

4. The solar LED lamp assembly of claim 3, wherein the reflector has a V-shaped configuration.

5. The solar LED lamp assembly of claim 1, wherein a length of each of the second supporting arms is longer than that of each of the first supporting arms, and a height of the second supporting arms is larger than that of the first supporting arms, the solar panel assembly being orient upwardly and slantwise towards a lateral side of the bracket.

6. The solar LED lamp assembly of claim 5, wherein the first supporting arms are spaced from each other, and wherein an elongated first connecting portion is mounted on top ends of the first supporting arms to connect the first supporting arms together.

7. The solar LED lamp assembly of claim 5, wherein the second supporting arms are spaced from each other, and wherein an elongated second connecting portion is mounted on top ends of the second supporting arms to connect the second supporting arms together.

8. The solar LED lamp assembly of claim 1, wherein a reflecting member with a plurality of receiving holes for the LED modules covers the printed circuit board and receives the LED modules in the receiving holes thereof.

9. The solar LED lamp assembly of claim 8, wherein a thermally conductive plate is sandwiched between the heat sink and the printed circuit board.

* * * * *